United States Patent [19]

Jacobsmeyer, Jr.

[11] Patent Number: 5,044,466

[45] Date of Patent: Sep. 3, 1991

[54] LADDER PLATFORM

[76] Inventor: Donald W. Jacobsmeyer, Jr., 1525 S. 8th St., St. Louis, Mo. 63104

[21] Appl. No.: 512,949

[22] Filed: Apr. 23, 1990

[51] Int. Cl.[5] ..... E06C 7/14

[52] U.S. Cl. ..... 182/121; 182/119; 248/238

[58] Field of Search ..... 182/121, 122, 120, 104, 182/105, 116, 117, 118, 119; 248/238

[56] References Cited

U.S. PATENT DOCUMENTS

| | | | |
|---|---|---|---|
| 1,166 | 4/1861 | Aldrich | 182/121 |
| 62,314 | 2/1867 | Burt | 248/238 |
| 78,988 | 7/1868 | Kendree | 182/104 |
| 211,389 | 1/1879 | Ellicott | 182/121 |
| 1,285,817 | 11/1918 | Sklar | 182/120 |
| 2,486,783 | 11/1949 | Hartman | 182/120 |
| 2,730,412 | 1/1956 | Yoder | 182/120 |
| 2,948,349 | 8/1960 | Reddy | 182/121 |
| 3,067,836 | 12/1962 | Carnicelli | 182/121 |
| 4,428,458 | 1/1984 | Fiore | 182/116 |
| 4,552,247 | 11/1985 | Purdy | 182/116 |

FOREIGN PATENT DOCUMENTS

| | | | |
|---|---|---|---|
| 154724 | 1/1954 | Australia | 182/121 |
| 2161529 | 1/1986 | United Kingdom | 182/121 |

*Primary Examiner*—Reinaldo P. Machado
*Attorney, Agent, or Firm*—Heller & Kepler

[57] ABSTRACT

A ladder platform preferably for extension ladders, has supports for receiving ladder rungs and supporting the platform in a generally level condition on any desired position between the top and the bottom of the ladder. The ladder platform provides support for someone working on the ladder and items that might be needed while working on the ladder.

20 Claims, 4 Drawing Sheets

LADDER PLATFORM

BACKGROUND OF THE INVENTION

The present invention relates in general to platforms for use with ladders and pertains, more particularly, to a platform for providing support directed to a ladder with rungs. The ladder support of this invention is an improvement over other ladder supports and provides support for someone working on the ladder and items that might be needed while working on the ladder.

With the conventional ladder it is generally necessary to place the ladder in position, climb the rungs and then stand on the rungs for extended periods of time while accomplishing the task at hand. It is common to attempt to provide support with planks or other flat members supported in some jury-rigged manner to the ladder rungs. Often wire or other bendable material will be used to secure the support to the ladder or the ladder rungs.

These homemade systems are unsafe at best. Another drawback to these methods is that the rigged support must be removed each time the ladder is moved. If the ladder is an extension ladder, then the support must be removed and replaced even when the ladder height is adjusted.

Accordingly, it is an object of the present invention to provide an improved ladder platform that is adapted to provide a stable, level platform for supporting an individual working on the ladder. With the platform of this invention the individual can work for an extended time without suffering the fatigue that normally occurs when standing for any length of time upon the relatively narrow ladder rung.

Another object of the present invention is to provide a ladder platform that is constructed to provide a moveable, relatively level platform that is adapted for use in association with a ladder with rungs.

A further object of the present invention is to provide a ladder platform that is adapted for use with either a single stringer ladder or a conventional extension ladder.

Still a further object of the present invention is to provide a ladder platform that can be manufactured from light weight, yet structurally sufficient material. The platform can be made, for example, from a combination of aluminum or steel.

Another object of the present invention is to provide a ladder platform that is relatively light weight for ease of use in placing it in position on the ladder and removing it from the ladder as required.

SUMMARY OF THE INVENTION

To accomplish the foregoing and other objects of this invention there is provided a ladder platform for supporting an individual on a relatively level platform along with any items that might be used while working on the ladder.

The ladder platform comprises support means supported by a plurality of ladder rungs, and framework means for maintaining the support means in operative engagement with the ladder rungs. The framework means is operatively associated with the support means and further defines a plurality of laterally spaced apart rung engaging members. The rung engaging members define rung receiving gaps that facilitate use of the platform.

The support surface may be attached, for example, by welding or other suitable means to the framework means and in a preferred embodiment the support surface provides a wear plate with a friction surface. One preferred friction surface is provided by an metal member welded to the framework means. The wear plate provides a platform upon which one can stand and place items while working on the ladder.

In the disclosed embodiment described herein, there are provided a plurality of support members attached to and depending from the framework means. Respective support members are spaced apart a transverse distance greater than the diameter of any engaged rung and a lateral distance less than the length of any engaged rung.

The platform support members in a preferred embodiment depend from the framework means at an angle providing for level platform support when the ladder is placed at a suggested angle with ground. It will be understood that ladders are typically placed against a generally vertical structure at an angle of approximately twelve degrees from vertical.

The preferred embodiment is adapted for use with an extension ladder and the support members are sized to be received between transversely spaced apart rungs on respective relatively movable portions of the extension ladder.

These and other objects and features of the present invention will be better understood and appreciated from the following detailed description of one embodiment thereof, selected for purposes of illustration and shown in the accompanying drawings.

DETAILED DESCRIPTION

Figure 3:
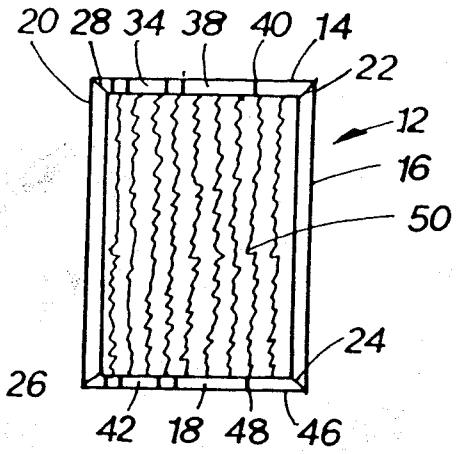
FIG. 3 is a bottom view of the ladder platform constructed in accordance with a preferred embodiment.
Figure 4:
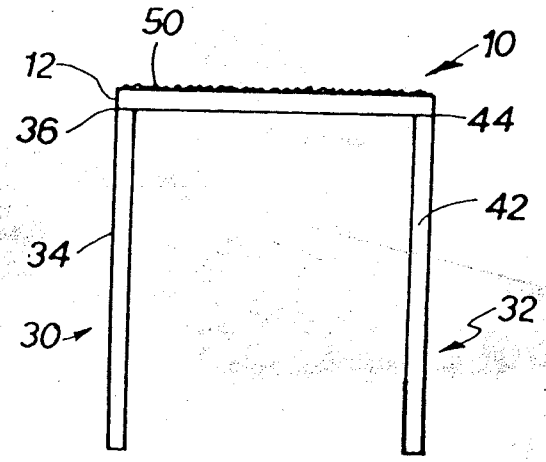
FIG. 4 is a front elevation view of the ladder platform constructed in accordance with a preferred embodiment.
Figure 1:
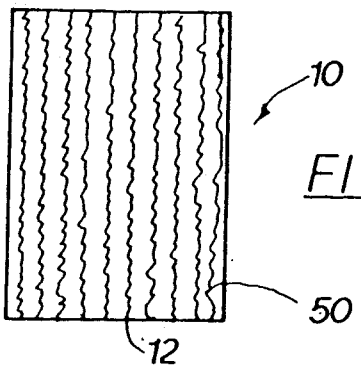
FIG. 1 is a plan view of a user support portion of the present invention.
Figure 2:
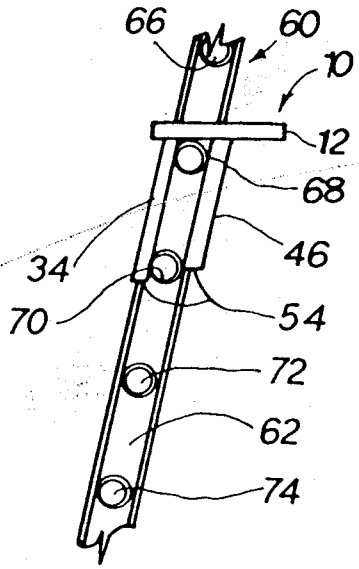
FIG. 2 is a cross-sectional view of a ladder platform constructed in accordance with the present invention in which cross section is taken generally along a longitudinal axis of the ladder platform.
Figure 5:
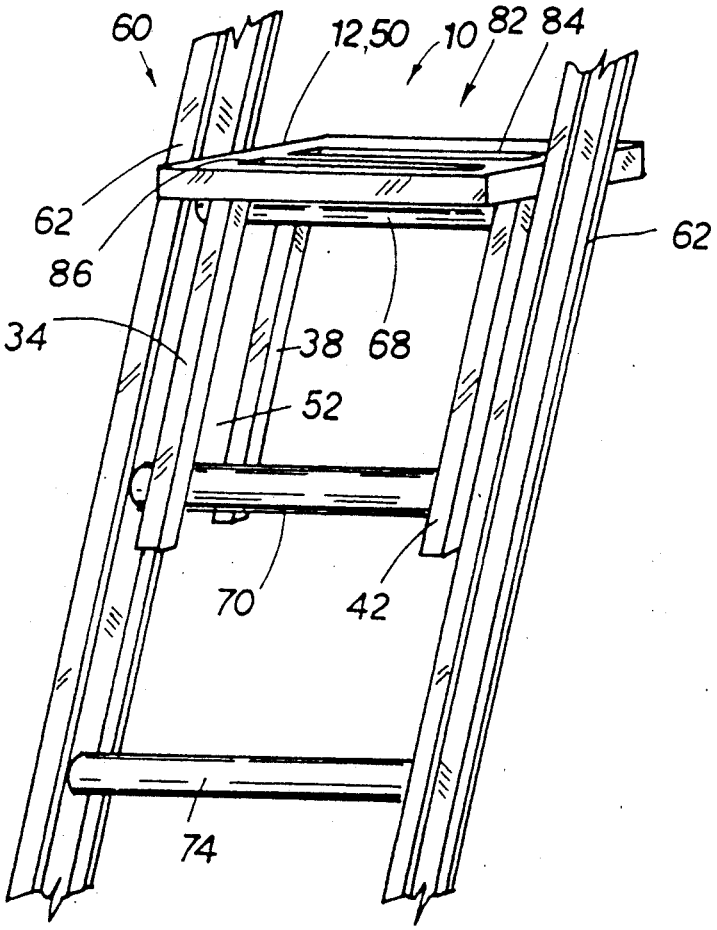
FIG. 5 is a perspective view of a ladder platform to show the platform in use on a ladder.

Referring now to the drawings there is shown a preferred embodiment for the ladder platform of this invention. The ladder platform is described in connection with a conventional ladder, both single section and multiple section extension ladder. The ladder platform of the present invention is particularly adapted for providing a generally level support on a rung-type ladder and is characterized by an support configuration that allows use of the ladder platform with conventional extension ladders.

The drawings show the ladder platform 10 in conjunction with a rung-type ladder and the platform comprises an underlying framework including a box-like frame 12. A support means generally depends from the frame 12. In the illustrated embodiment the support means include a plurality of supports. The supports include a first support 14, a second support 16, a third support 18, and a fourth support 20.

The support can be attached to the frame 12 in any suitable manner. For example, threaded fasteners or rivet-type fasteners could be used. In the illustrated embodiment the supports are welded as represented by reference characters 22, 24, 26, and 28.

The supports provide a pair of lateral leg or support pairs, a first pair of lateral legs 30 and second pair of lateral legs 32. The first pair of lateral legs include a forward leg 34 and its associated weld 36 and a rearward leg 38 and its associated weld 40. Similarly, the second pair of lateral legs include another forward leg 42 and its associated weld 44 and another rearward leg 46 and its associated weld 48.

A platform member 50 provides the desired supporting features of the present invention. The platform member may be of any desired friction surface, preferably one that wears well under severe use. In a preferred embodiment depicted in the drawings, the platform is an expanded metal sheet in which the exposed or expanded portions extend upward to provide the desired friction surface.

In operation, in connection with an extension ladder 60 lateral distance between the first and second lateral legs 30, 32 is less than the rung length. The ladder platform 10 is constructed to fit between conventional stringer assemblies either front 62 or rear 64. Each stringer assembly includes it respective front rungs 66, 68, 70, 72, and 74, as well as its respective rear rungs 76, 78, and 80.

The first and second lateral leg pairs 30 and 32 with their respective supports define rung receiving gaps 52 and 54. When placed over the rungs of the ladder the supports or legs extend down and on either side of at least two rungs, thereby supporting the ladder platform 10 as desired. The top rung further provides support for the bottom portion or box-like frame 12 of the platform 10.

Figure 6:
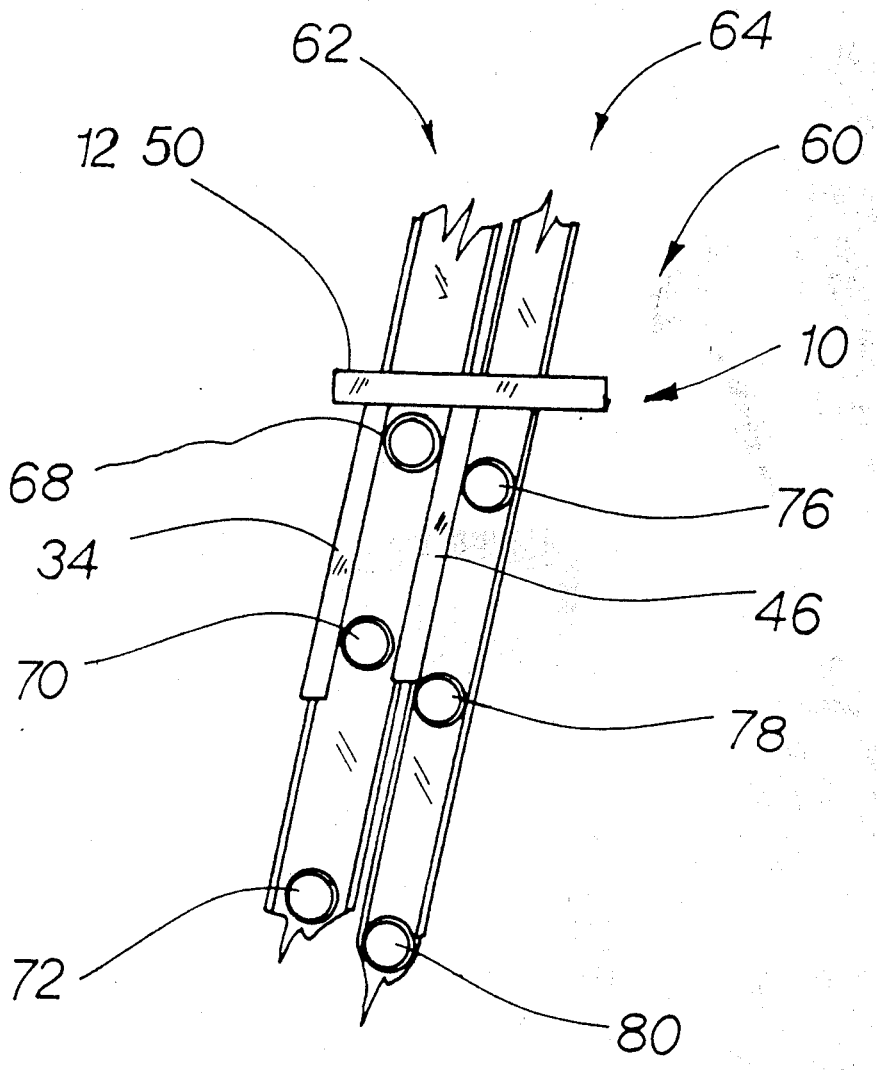
FIG. 6 is cross-sectional view of the ladder platform generally depicted in FIG. 2 and in use with a conventional extension ladder.
Figure 7:
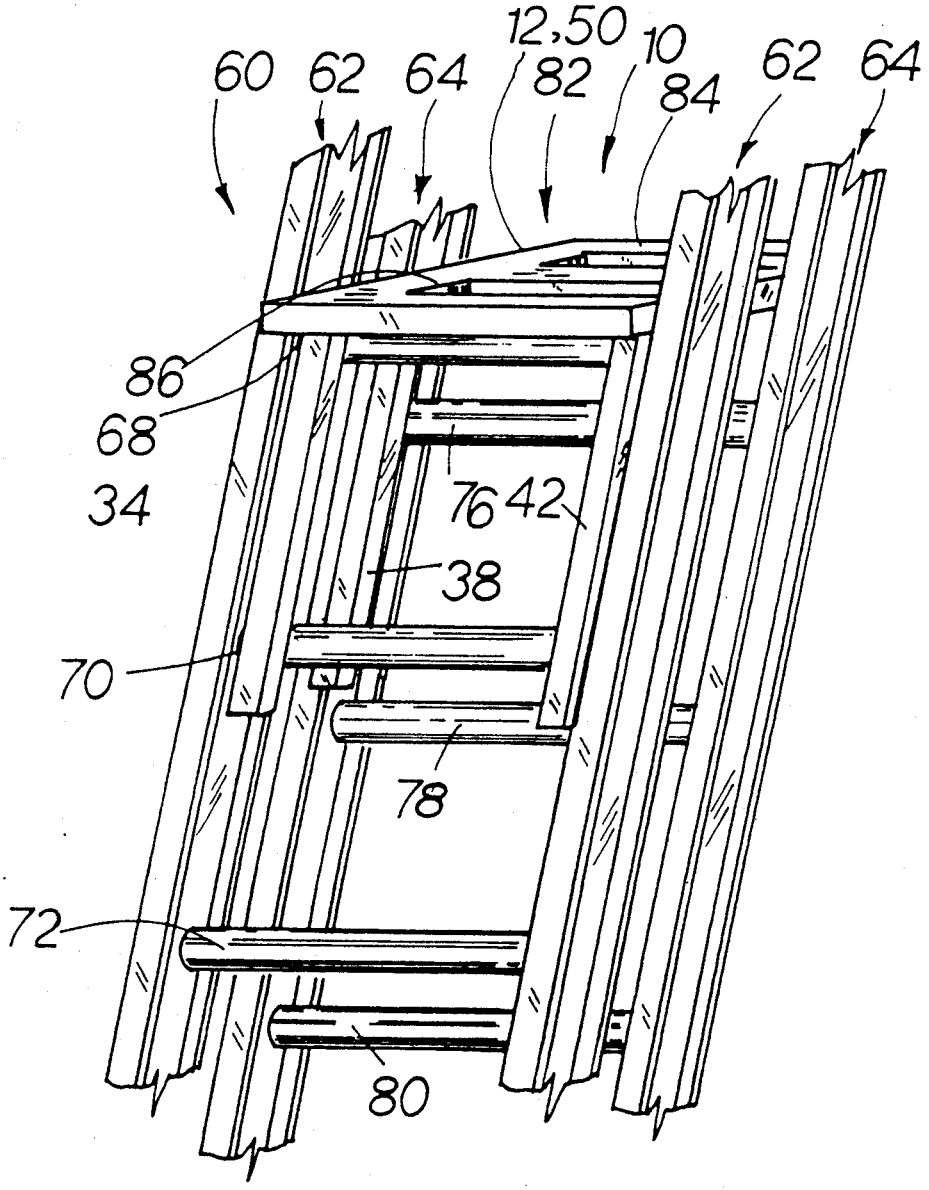
FIG. 7 is a perspective view of the extension ladder application generally depicted in FIG. 7.

It will be further observed from FIGS. 6 and 7 that the supports, and particularly the rearward legs fit between the front and rear rungs when the present invention is used in conjunction with an extension ladder. It will be further understood that the present invention can be used with extension ladders of more than two stringer assemblies.

In a preferred embodiment the forward legs are slightly longer than the rearward legs. This arrangement facilitates proper placement of the platform 10. The longer front legs 34, 42 can be used to "hook" or catch the topmost rung 68 to guide this rung fit into the gaps 52 and 54.

From the foregoing description those skilled in the art will appreciate that all of the objects of the present invention are realized. The present invention provides an improved ladder platform characterized by its stable, level platform capable of supporting an individual working on the ladder. With the platform of this invention the individual can work for an extended time without suffering the fatigue that normally occurs when standing for any length of time upon the relatively narrow ladder rung.

The present invention provides a ladder platform that is constructed to provide a moveable, relatively level platform that is adapted for use in association with a ladder with rungs. The ladder may be a conventional single stringer or multiple stringer extension ladder. The ladder platform is readily manufactured from light weight, yet structurally sufficient material. The platform can be made, for example, from either aluminum or steel welded supports and members.

The relatively light weight embodiment of this invention allows ease of use and stability not found in conventional solutions to the problems addressed by the platform. It is desired to provide a ladder platform that provides the user that works extended time on the ladder relief from the fatigue and possible damage that long term standing on the rung of a ladder while performing manual labor often causes.

While specific embodiments have been shown and described, many variations are possible. The particular shape of the and material of the platform member 50 may be changed to suit particular applications. The material describe as related is a metal construction, however, those skilled in the art will recognize that strong, light weight, plastics may be substituted for the metal construction. Furthermore, to facilitate use of the present invention, a handle portion 82 can be formed in the platform 50 by providing a pair of parallel slots 84, 86 or any other suitable handle means. The handle allows a user to grasp the ladder platform 10 for removal or placement over the ladder rungs as previously described. The handle means also provides for carrying the ladder platform 10.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. A platform for supporting an individual, tools, or other items while working on an extension a ladder with rungs, the platform comprising:

support means supported by a plurality of ladder rungs;

framework means for maintaining the support means in operative engagement with the ladder rungs, the framework means operatively associated with the support means, the framework means defining at least two laterally spaced apart rung engaging members, each rung engaging member receiving a plurality of ladder rungs; and each of the rung engaging members defining a rung receiving gap.

2. A platform as set forth in claim 1 wherein the support means comprises a support surface attached to the framework means.

3. A platform as set forth in claim 2 wherein the underlying framework provides support for a wear plate upon which one can stand and place items, whereby the wear plate has a friction surface for impeding movement and slipping across the wear plate load bearing surface.

4. A platform as set forth in claim 3 wherein the wear plate is an expanded metal member and exposed portions of the expanded metal provide the desired friction surface.

5. A platform as set forth in claim 1 wherein the laterally spaced apart rung engaging members comprise:

a first support member attached to and depending from the framework means;

a second support member attached to and depending from the framework means, the second support member spaced apart from the first support member a transverse distance greater than the diameter of any engaged rung;

a third support member attached to and depending from the framework means, the third support member spaced apart from the first support means a lateral distance less than the length of any engaged rung; and a fourth support member attached to and depending from the framework means, the fourth support member spaced apart from the third support member the transverse distance greater than the diameter of any engaged rung, the fourth support member spaced apart from the second support member the lateral distance less than the length of any engaged rung.

6. A platform as set forth in claim 5 wherein the support members depend from the framework means at an angle providing for level platform support when the ladder is placed at a suggested angle with ground.

7. A platform as set forth in claim 6 wherein the support members all depend from the framework means at an angle of approximately twelve degrees.

8. A platform as set forth in claim 5 wherein the support legs are welded to the framework means.

9. A platform supporting an individual, tools, or other items while working on an extension ladder with rungs, the platform comprising:

support means supported by a plurality of ladder rungs;

framework means for maintaining the support means in operative engagement with the ladder rungs, the framework means operatively associated with the support means, the framework means defining at least two laterally spaced apart rung engaging members, each rung engaging member receiving a plurality of ladder rungs; and each of the rung engaging members defining a rung receiving gap, the rung engaging members sized to be received between transversely spaced apart rungs on respective relatively movable portions of the extension ladder.

10. A platform as set forth in claim 9 wherein the support means comprises a support surface attached to the framework means.

11. A platform as set forth in claim 10 wherein the underlying framework provides support for a wear plate upon which one can stand and place items, whereby the wear plate has a friction surface for impeding movement and slipping across the wear plate load bearing surface.

12. A platform as set forth in claim 11 wherein the wear plate is an expanded metal member and exposed portions of the expanded metal provide the desired friction surface.

13. A platform as set forth in claim 9 wherein the laterally spaced apart rung engaging members comprise:

a first support member attached to and depending from the framework means;

a second support member attached to and depending from the framework means, the second support member spaced apart from the first support member a transverse distance greater than the diameter of any engaged rung;

a third support member attached to and depending from the framework means, the third support member spaced apart from the first support means a lateral distance less than the length of any engaged rung; and a fourth support member attached to and depending from the framework means, the fourth support member spaced apart from the third support member the transverse distance greater than the diameter of any engaged rung, the fourth support member spaced apart from the second support member the lateral distance less than the length of any engaged rung.

14. A platform as set forth in claim 13 wherein the support members depend from the framework means at an angle providing for level platform support when the ladder is placed at a suggested angle with ground.

15. A platform as set forth in claim 14 wherein the support members all depend from the framework means at an angle of approximately twelve degrees.

16. A platform as set forth in claim 13 wherein the support legs are welded to the framework means.

17. A platform supporting an individual, tools, or other items while working on an extension ladder with rungs, the platform comprising:

support means supported by a plurality of ladder rungs;

framework means for maintaining the support means in operative engagement with the ladder rungs, the framework means operatively associated with the support means, the framework means defining at least two laterally spaced apart rung engaging members, each rung engaging member receiving a plurality of ladder rungs;

a support surface attached to the framework means, the support surface including handle means;

each of the rung engaging members defining a rung receiving gap, the rung engaging members sized to be received between transversely spaced apart rungs on respective relatively movable portions of the extension ladder;

the rung engaging members further including:

a first support member attached to and depending from the framework means;

a second support member attached to and depending from the framework means, the second support member spaced apart from the first support member a transverse distance greater than the diameter of any engaged rung;

a third support member attached to and depending from the framework means, the third support member spaced apart from the first support means a lateral distance less than the length of any engaged rung;

a fourth support member attached to and depending from the framework means, the fourth support member spaced apart from the third support member the transverse distance greater than the diameter of any engaged rung, the fourth support member spaced apart from the second support member the lateral distance less than the length of any engaged rung; and the support members depend from the framework means at an angle providing for level platform support when the ladder is placed at a suggested angle with ground.

18. A platform as set forth in claim 17 wherein the underlying framework provides support for a wear plate upon which one can stand and place items, whereby the wear plate has a friction surface for impeding movement and slipping across the wear plate load bearing surface and the friction surface is provided by an expanded metal member.

19. A platform as set forth in claim 17 wherein forward support members are longer than rearward support members.

20. A platform as set forth in claim 17 wherein the support members all depend from the framework means at an angle of approximately twelve degrees.

* * * * *